US007098585B2

(12) United States Patent
Baek et al.

(10) Patent No.: US 7,098,585 B2
(45) Date of Patent: Aug. 29, 2006

(54) CATHODE RAY TUBE INCLUDING A FUNNEL WITH A NON-CIRCULAR SHAPED FUNNEL YOKE PORTION

(75) Inventors: Jae-Seung Baek, Kyeongeangbuk-Do (KR); Ryo-Hyang Kim, Kyeongeangbuk-Do (KR)

(73) Assignee: LG. Philips Displays Korea Co., Ltd., Kyeongsangbuk-Do (KR)

( * ) Notice: Subject to any disclaimer, the term of this patent is extended or adjusted under 35 U.S.C. 154(b) by 295 days.

(21) Appl. No.: 10/241,524

(22) Filed: Sep. 12, 2002

(65) Prior Publication Data

US 2003/0222568 A1 Dec. 4, 2003

(30) Foreign Application Priority Data

May 29, 2002 (KR) ..... 2002-0029974

(51) Int. Cl.
*H01J 31/00* (2006.01)

(52) U.S. Cl. ..... 313/477 R; 220/2.1 R; 220/2.2; 220/2.1 A

(58) Field of Classification Search ..... 313/477 R; 220/2.1 R, 2.1 A, 2.2, 2.3 A
See application file for complete search history.

(56) References Cited

U.S. PATENT DOCUMENTS 5,170,102 A * 12/1992 Sluyterman et al. ..... 313/403
5,929,559 A 7/1999 Sano et al.
5,962,964 A 10/1999 Sano et al.
6,323,591 B1 * 11/2001 Oosterhout et al. ..... 313/477 R
6,359,379 B1 * 3/2002 Lee et al. ..... 313/477 R
6,380,668 B1 * 4/2002 Kim et al. ..... 313/477 R
6,528,936 B1 * 3/2003 Lee et al. ..... 313/477 R
6,608,645 B1 * 8/2003 Kunitake ..... 313/634

FOREIGN PATENT DOCUMENTS

JP 2000-149826 A 5/2000
JP 2002063858 A * 2/2002

* cited by examiner

*Primary Examiner*—Mariceli D. Santiago
(74) *Attorney, Agent, or Firm*—Birch, Stewart, Kolasch & Birch, LLP

(57) ABSTRACT

A cathode ray tube includes a panel, a funnel and a funnel yoke portion having a non-circular-shaped vertical section. When a diagonal portion thickness on a certain vertical section between a reference line and a neck line is Td and a long side portion thickness at the same vertical section is Th, a glass structure of a cathode ray tube satisfies 0.5<Th/Td<1.01. When a diagonal portion thickness at a top round is Dt', a long side portion thickness is $D_S$', a short side portion thickness is $D_L$', a diagonal portion thickness at a reference line is Dt, a long side portion thickness is $D_S$, and a short side portion thickness is $D_L$, then the glass structure of a cathode ray tube satisfies 1.3≦Dt'/Dt<1.80.

20 Claims, 8 Drawing Sheets

CATHODE RAY TUBE INCLUDING A FUNNEL WITH A NON-CIRCULAR SHAPED FUNNEL YOKE PORTION

BACKGROUND OF THE INVENTION

1. Field of the Invention

The present invention relates to a cathode ray tube, and in particular to a glass structure of a cathode ray tube which is capable of improving a deflection efficiency of a cathode ray tube, preventing a BSN phenomenon occurrence and lowering high stress acting on a funnel efficiently while improving the deflection efficiency.

2. Description of the Prior Art

Generally, a BSN (beam shadow neck) means a phenomenon in which a deflected electron beam clashes onto the internal surface of a yoke portion and throws a shadow on a screen.

As depicted in FIG. 1, the conventional color cathode ray tube includes a R (red)•G (green)•B (blue) fluorescent 40 coated onto the internal surface, a panel 10 having an explosion-proof means at the front surface, a funnel 20 welded to the rear end of the panel 10, an electron gun 130 inserted into a neck portion of the funnel 20 and generating an electron beam 60, a deflection yoke 50 for deflecting the electron beam 60, a shadow mask 70 installed to the inner surface of the panel 10 with a certain space and having plural holes for passing the electron beam 60, a mask frame 30 fixedly supporting the shadow mask 70 to make the shadow mask 70 maintain a certain distance from the panel 10, a spring 80 for connecting and supporting the mask frame 30 and the panel 10, an inner shield 90 for shielding the cathode ray tube not to be influenced by outer terrestrial magnetism, and a reinforcing band 110 installed to the circumference of the side surface of the panel 10 and absorbing outer impacts.

A general fabrication process of the conventional color cathode ray tube can be divided into the first half process and the latter half process, and the first half process is coating a fluorescent surface 40 onto the internal surfaces of the panel 10, and the latter half process consists of several processes, that are discussed below.

First, in a sealing process, the panel 10 in which the fluorescent surface is coated and includes a mask assembly is joined to the funnel 20 in which frit is coated onto the sealing surface. Afterward, in an enclosing process, the electron gun 130 is inserted into the neck portion 140 of the funnel 20. And, in an exhausting process the cathode ray tube is sealed after being vacuumized.

Herein, when the cathode ray tube is in the vacuum state, a high tensile force and a high compressive stress act on the panel 10 and the funnel 20.

Accordingly, after the exhausting process, in order to disperse the high stress acting on the front surface of the panel 10, a reinforcing process for adhering the reinforcing band 100 is performed.

An unexplained reference numeral 11 is a funnel body portion, 12 is a funnel yoke portion, 51 is a deflection core, and 52 is a deflection coil.

In the cathode ray tube, because the electron beam 60 reaches the fluorescent 40 coated onto the internal surface of the panel 10, a picture is formed. In order to move the electron beam 60 harmoniously, the internal surface of the cathode ray tube has to be in a vacuum state.

In addition, in order to form a picture on the screen, the electron beam 60 discharged from the cathode of the electron gun 130 has to be deflected while spreading widely on the screen, the deflection yoke 50 consisting of the coil 51 and the core 52 deflects the electron beam.

When a current flows onto the coil 52 of the deflection yoke 50, a magnetic field occurs in the core 51, and the electron beam 60 is deflected while moving along a Z axis by the generated magnetic field.

Herein, a size of the magnetic field is varied according to an amplitude of the current applied to the coil 52.

Generally, a deflection angle and a deflection center of the electron beam 60 is determined according to a size, a shape, a position of the coil 52 and the core 51 of the deflection yoke 50.

In addition, according to intensification of electronic appliance power consumption regulations, attempts to lower the power consumption of electronic appliances have been made. As well as other electronic appliances, lowering power consumption is an essential particular in the cathode ray tube.

In order to slim down the cathode ray tube and reduce power consumption thereof, a current applied to the deflection yoke 50 has to be decreased.

However, when the applied current is reduced, because the magnetic field generated in the core 51 is weakened, a sufficient deflection angle can not be secured, and accordingly a picture can not be formed.

In addition, when an absolute quantity of the core 51 and the coil 52 of the deflection yoke 50 is increased, a material cost and an absolute quantity of a leakage magnetic field are increased, and accordingly it is not good in the product reliability aspect.

Accordingly, because slimming down and reducing the power consumption of the cathode ray tube are greatly related to the deflection efficiency of the deflection yoke 50, improving the efficiency of the deflection yoke 50 is efficient way to slim down the cathode ray tube and reduce the power consumption thereof.

There are methods for improving the deflection efficiency. A first method is changing a section shape of the funnel yoke portion 12 and the coil 52 from a circular shape to a square shape. In the first method, because a distance between the electron beam 60 and the deflection yoke 50 is reduced, the electron beam 60 can be easily deflected by a smaller deflection magnetic field.

A second method is placing the core 51 and the coil 52 of the deflection yoke 50 at the neck portion 13 of the funnel 20.

In the second method, as depicted in FIG. 2, when the position of the deflection yoke 50 is changed so as to get closer to the neck portion 13 of the funnel 20, a distance D (before the change) between the deflection yoke 50 and the electron beam 60 is shorter than a distance d (after the change). Accordingly, the electron beam 60 crashes onto the internal surface of the funnel 20 at the is overlap portion.

In more detail, when the deflection center is moved toward the neck portion 13, a distance between the electron beam 60 and the deflection yoke 50 is reduced, the electron beam 60 can be influenced by a larger deflection magnetic field.

Because a distance between the electron beam 60 and the yoke portion 12 of the funnel 20 is smaller, the electron beam 60 crashes onto the internal surface of the yoke portion 12 and throws a shadow on the screen.

The section of the funnel yoke portion 12 is getting smaller toward the neck portion 13 of the funnel yoke portion 12, by reducing a distance between the electron beam 60 and the deflection yoke 50, a deflection efficiency can be improved.

The position change means moving the deflection center toward the neck portion 13, and accordingly the electron beam 60 is deflected early by the magnetic field.

In addition, third method is converting an electron beam scanning type from a horizontal scanning type into a vertical scanning type.

Generally, the cathode ray tube has a ratio of horizontal length:vertical length as 4:3 or 16:9. In the horizontal scanning type, 4, 16 distance has to be deflected. But, in the vertical scanning type, merely 3, 9 distance has to be deflected, a deflection electric power for the same deflection is smaller than that of the horizontal scanning type.

FIG. 3 illustrates a BSN phenomenon occurring at the yoke portion 12 of the funnel 20 of the cathode ray tube in applying of the vertical scanning type. As depicted in FIG. 3, the BSN phenomenon is caused by the electron gun arranged in the vertical scanning type and mainly occurs along the long side portion and the diagonal portion of the yoke portion 12.

Recently, in practical use, all three methods have been combined to improve the deflection efficiency, the improvement of the deflection efficiency makes possible to slim down the cathode ray tube and reduce a power consumption thereof.

In the meantime, FIG. 4 illustrates a BSN phenomenon that occurs by the electron beam 60 crashing onto the internal surface of the yoke portion 12 of the funnel 20 according to the deflection efficiency improvement in applying of the three methods.

In more detail, the lower the deflection efficiency, the more a BSN phenomenon occurrence portion moves toward a TOP (top of round), the higher the deflection efficiency, the more a BSN phenomenon occurrence portion moves toward a NSL (neck seal line).

Accordingly, a BSN phenomenon occurrence between a RL (reference line) and the NSL (neck seal line) is inevitable.

The BSN phenomenon occurrence according to the deflection efficiency increase is a major problem in slimming down the cathode ray tube and reducing a power consumption thereof.

However, the methods for improving the deflection efficiency increase the BSN phenomenon occurrence according to the electron beam deflection. The BSN phenomenon means a phenomenon in which a shadow of the internal surface of the yoke portion 12 is thrown onto the screen, it is very important characteristic in fabricating of the cathode ray tube.

In recent years, to improve the deflection efficiency of the cathode ray tube, a funnel having a square-shaped yoke portion and the vertical scanning type are applied to the cathode ray tube, however, those applications cause more BSN phenomenon occurrence than that in application of a funnel having the conventional circular shaped yoke portion and the horizontal scanning type.

In more detail, in application of the funnel having a square-shaped yoke portion, a distance between the electron beam 60 and the yoke portion 12 is reduced. In moving of the deflection center toward the neck portion 13, because a deflection angle of the electron beam 60 is increased and the electron beam 60 moves toward the internal surface of the yoke portion 13, the BSN phenomenon occurrence is increased, and accordingly a reliability of the cathode ray tube may be lowered.

In addition, in the vertical scanning type cathode ray tube, each R, G, B cathode emitting the electron beam 60 from the electron gun 130 has to be placed so as to be parallel to the vertical axial line. Herein, the electron beam emitted from the R, B cathodes is placed apart a certain distance from the Z axis in the vertical direction in comparison with the G electron beam.

Herein, because the electron beam emitted from the R, B cathodes gets closer to the deflection magnetic field as the distance separated from the Z axis, the electron beam 60 is deflected toward the vertical direction and crashes onto the internal surface of the long side of the funnel yoke portion 12, and accordingly the BSN phenomenon occurs.

The above-mentioned phenomenon greatly occurs between the funnel yoke portion 12, the RL (reference line) and the NSL (neckline seal line).

In the slim and the vertical scanning type cathode ray tube, the BSN phenomenon occurs along the diagonal portion and the long side portion, most of all, it mainly occurs at the long side's internal surface around the diagonal portion of the funnel yoke portion 12.

Herein, when the funnel yoke portion 12 is moved to the direction perpendicular to the Z axis (central axis), namely, gets farther apart, the BSN phenomenon is reduced, however, the deflection efficiency is lowered, and accordingly it is impossible to slim down the cathode ray tube and reduce power consumption thereof.

In the meantime, in the present display market, slimming down a display's volume is essential to facilitate a secure installation space. For example, a LCD (liquid crystal display) and a PDP, etc. are typical slim displays. In comparison with them, the cathode ray tube is heavy and large, and it is in a disadvantageous position in the installation facilitation, and accordingly it is required to slim down.

With the trend, in order to slim down the cathode ray tube, it is essential to secure the deflection angle, for that, the yoke portion 12 has the square shape, however, because it is an unstable shape in the structural aspect, a high stress acts on the panel 10 and the funnel 20.

FIG. 5 is a schematic view illustrating a stress distribution on the yoke portion 12 of the funnel 20. As depicted in FIG. 5, by reducing the total length of the funnel 20 to slim down the cathode ray tube, a stress acts on the yoke portion 12 of the cathode ray tube. In FIG. 5, a dotted line arrow mark is a compression stress, a solid line arrow mark is a tensile stress. Herein, in the funnel 20 made of glass, the intensified stress distribution can be a fetal problem.

In more detail, when the funnel yoke portion 12 has the square shape, because the tensile stress on the outer surface of diagonal portion of the yoke portion 12 is increased, a high stress problem on the glass has to be solved.

In other words, when the cathode ray tube is slimmed down, the total length of the funnel 20 is shortened. In addition, when the yoke portion 12 has a square shape, a stress on the yoke portion 12 is increased, a deflection angle of the electron beam 60 of the electron gun to the fluorescent 40 is increased, and accordingly the BSN phenomenon occurs. In that case, a shadow is thrown around the fluorescent, and it may lower the reliability of the cathode ray tube.

SUMMARY OF THE INVENTION

In order to solve the above-mentioned problem, it is an object of the present invention to provide a glass structure of a cathode ray tube which is capable of improving a deflection efficiency of a cathode ray tube, restraining BSN phenomenon occurrence and lowering a high stress acting on a funnel efficiently.

In order to achieve the above-mentioned object, in a vacuumized cathode ray tube consisting of a panel and a funnel and including a funnel yoke portion having a non-circular-shaped vertical section, when a diagonal portion thickness an a certain vertical section between a reference line and a neck line is Td and a long side portion thickness at the same vertical section is Th, a glass structure of a cathode ray tube satisfies $0.5<Th/Td<1.01$.

In addition, in order to achieve the above-mentioned object, when a diagonal portion thickness at a top of round is Dt', a long side portion thickness is $D_S'$, a short side portion thickness is $D_L'$, a diagonal portion thickness at a reference line is Dt, a long side portion thickness is $D_S$, a short side portion thickness is $D_L$, a glass structure of a cathode ray tube in accordance with the present invention satisfies $1.3 \leqq Dt'/Dt < 1.80$.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
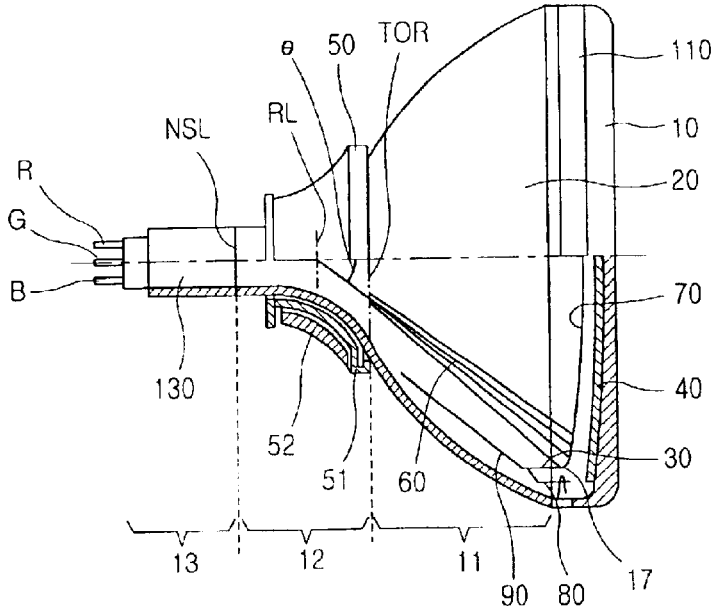
FIG. 1 CONVENTIONAL ART
FIG. 1 is a vertical sectional view illustrating the conventional cathode ray tube.
Figure 2:
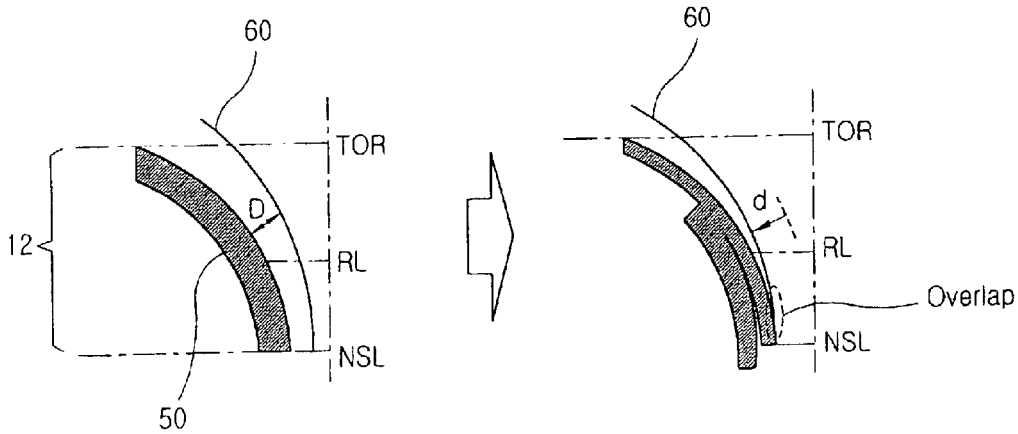
FIG. 2 CONVENTIONAL ART
FIG. 2 is a schematic view illustrating a BSN phenomenon occurrence according to moving of a deflection center of the conventional cathode ray tube.
Figure 3:
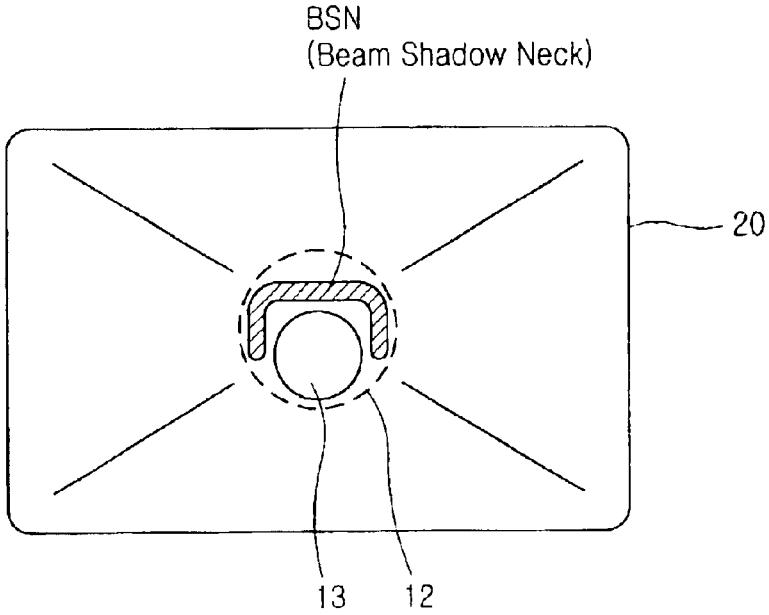
FIG. 3 CONVENTIONAL ART
FIG. 3 is a schematic view illustrating a BSN phenomenon occurrence in a vertical scanning type.
Figure 4:
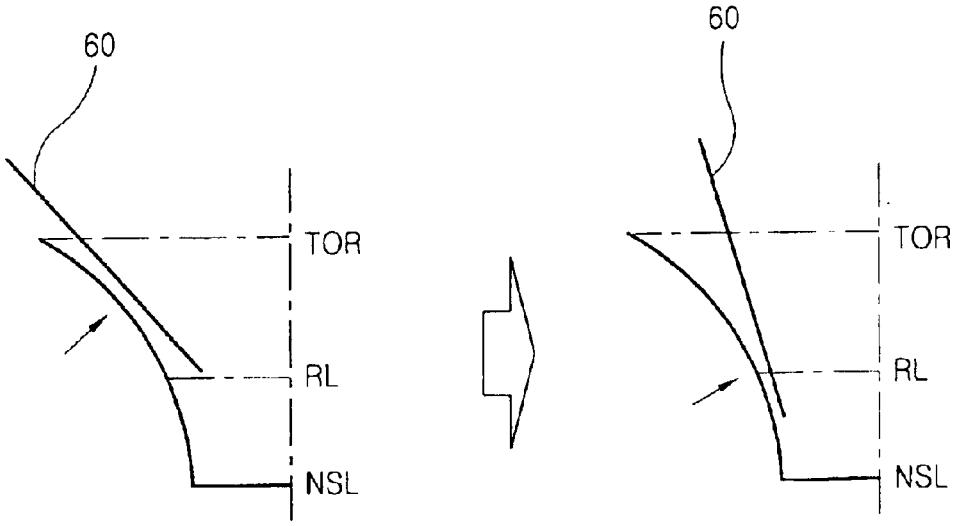
FIG. 4 CONVENTIONAL ART
FIG. 4 is a schematic view illustrating a BSN phenomenon occurrence according to deflection efficiency increase.
Figure 5:
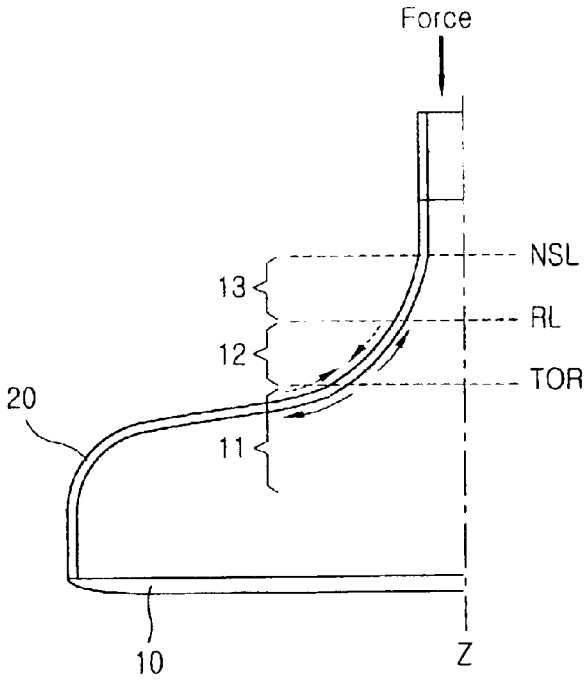
FIG. 5 CONVENTIONAL ART
FIG. 5 is a schematic view illustrating a stress distribution when the internal space of the cathode ray tube is vacuumized.
Figure 6:
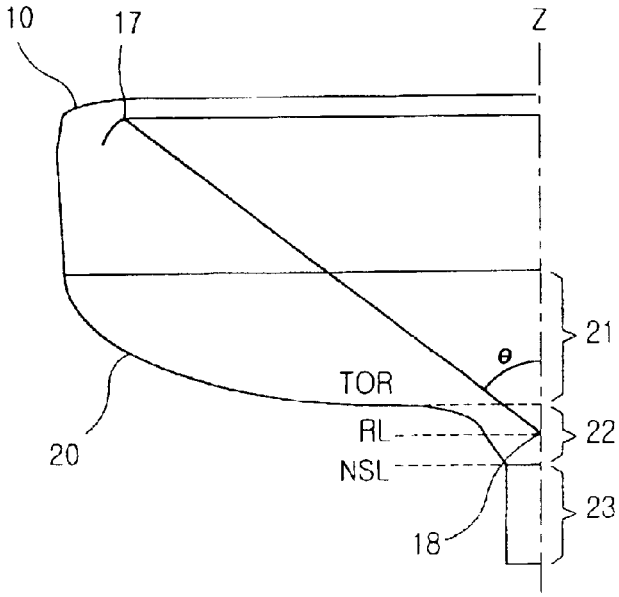
FIG. 6 is a schematic view illustrating each definition value for describing the present invention.

FIG. 6 is a schematic view illustrating a reference line and a reference point for describing a glass structure of a cathode ray tube in accordance with the present invention.

A TOR (top of round) means a border line at which a yoke portion 22 of a funnel 20 of a deflection yoke meets a body portion 21 of the funnel 20.

A NSL (neck seal line) means a border line at which the yoke portion 22 of the funnel 20 meets a neck portion 23 at which an electron gun 60 is placed.

A RL (reference line) is an imaginary reference line of the funnel 20, when a cross point of a Z axis (central axis) and the RL is connected to an end 17 of a diagonal effective area of a screen as a straight line, an angle of the straight line to the Z axis is defined as a deflection angle (θ).

And, a deflection angle (θ) in FIG. 6 is ½ of an actual deflection angle.

The effective area means a region in which a picture is displayed on a screen of the panel 10 when a cathode ray tube is operated, the effective area end 17 means a diagonal end of the picture.

In addition, in FIG. 6, a slim type cathode ray tube is defined as a cathode ray tube having a slope angle to the Z axis not less than 50° and less than 70° when the diagonal effective area end 17 is connected to a reference point 18 (imaginary reference point shown in FIG. 6).

In addition, a deflection center means a point at which an electron beam is deflected by a deflection yoke, in the present invention, the center of a core 51 of a deflection yoke 50 is the deflection center.

In the meantime, in order to reduce BSN phenomenon occurrence, by increasing section of the yoke portion 12 of the funnel 20, a distance between the electron beam and the deflection yoke is increased or by moving the center of the deflection yoke toward the panel 10, a deflection point of the electron beam is moved toward the panel 10.

However, because those methods lower efficiency of the deflection yoke 50, it is impossible to slim down the cathode ray tube and reduce a power consumption thereof.

Therefore, in order to reduce the BSN phenomenon occurrence and increase efficiency of the deflection yoke 50 simultaneously, only the internal surface thickness of the yoke portion 22 has to be reduced while the outer surface of the BSN phenomenon occurrence portion is fixed, or the internal surface shape of the yoke portion 22 has to be optimized.

In the conventional funnel design concept, in order to reduce the internal surface thickness of the yoke portion or optimize the internal surface shape thereof, a thickness or a shape is increased/reduced or changed on the basis of the RL of the funnel 10.

However, in the conventional design concept, it is impossible to achieve a deflection efficiency sufficient for slimming down the cathode ray tube and reducing a power consumption thereof.

Accordingly, in the present invention, in order to reduce BSN phenomenon occurrence around a RL~NS of a funnel yoke portion and secure deflection efficiency increase sufficient for slimming down the cathode ray tube and reducing a power consumption thereof on the basis of a BSN margin, a structure of a yoke portion 22 of a funnel 200 satisfies follow equations.

Figure 7:
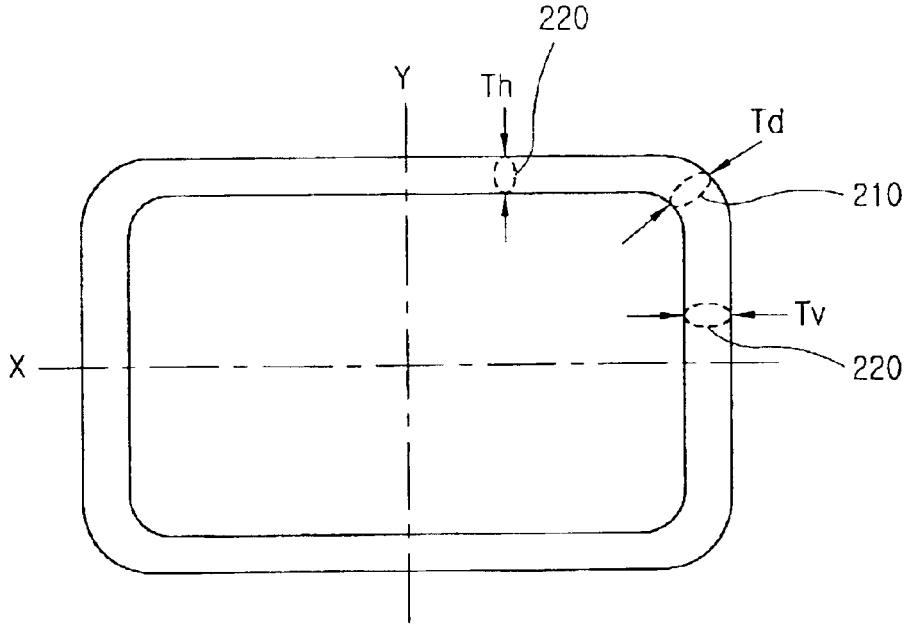
FIG. 7 is a sectional view illustrating a funnel yoke portion in accordance with the present invention.

First, FIG. 7 shows a section shape cut from a certain point of the funnel yoke portion 22 so as to be perpendicular to the Z axis line.

The Z axis line is a straight line connecting the neck portion's center to the panel's center.

Herein, in FIG. 7, when a thickness of a diagonal portion 210 is Td and a thickness of the long side portion 220 is Th, the internal surface of the yoke portion 22 satisfies a follow Equation 1.

$$0.5 < Th/Td < 1.01 \quad (1)$$

It means the long side portion thickness Th of the funnel yoke portion 22 is thinner than the diagonal portion thickness Td.

In general, in the funnel yoke portion 22, from the NSL (neck seal line) to the TOR (top of round), the section shape is changed from a circular shape to a non-circular shape. In that case, because a distance between the long side internal surface of the yoke portion 22 and the electron beam is shorter than that of the conventional cathode ray tube having only the circular shape, it is weaker to the BSN phenomenon occurrence, a maximum tensile stress acts toward the TOR (top of round), and accordingly a structure strength of the cathode ray tube is weakened.

Therefore, in order to optimize the internal surface shape of the funnel yoke portion 22, the long side portion thickness and the diagonal portion thickness have to satisfy the Equation 1, and accordingly a deflection efficiency and a BSN margin can be improved.

In addition, in order to reduce a tensile stress acting on the diagonal portion 210 of the yoke portion 22, a thickness Td of the diagonal portion 210 is increased, and accordingly a structural strength of the cathode ray tube can be improved.

Accordingly, in order to secure the structural strength of the slim type cathode ray tube having a deflection angle not less than 100°, it is preferable to satisfy 0.8<Th/Td<1.01.

Figure 8:
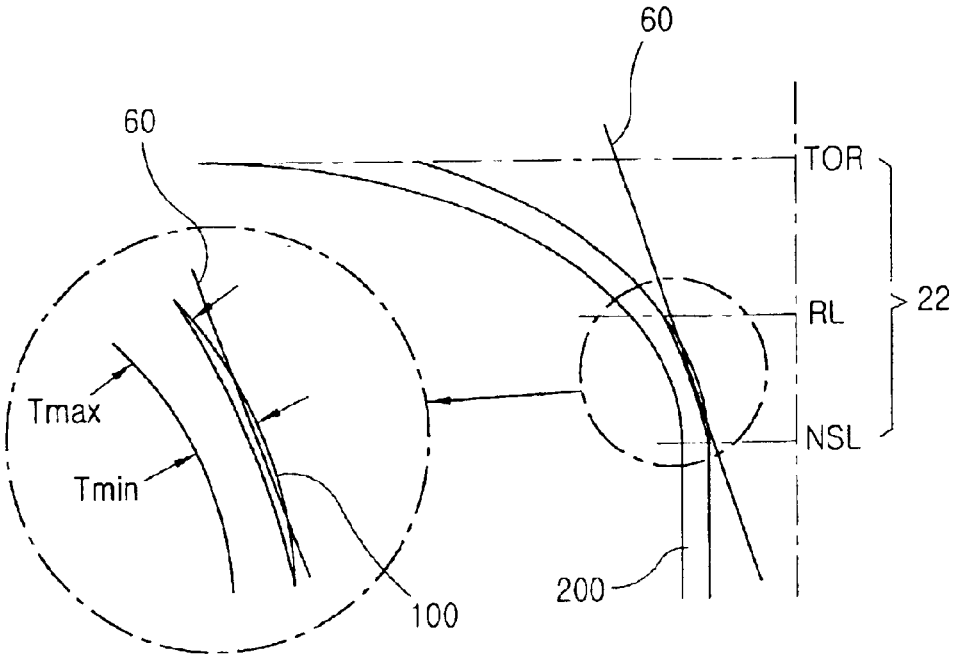
FIG. 8 is a sectional view illustrating a funnel yoke portion in accordance with the present invention.

FIG. 8 illustrates a section shape of the funnel yoke portion 22 for preventing a BSN phenomenon occurrence in the NSL~RL region according to the deflection efficiency increase.

Herein, in the NSL~RL region, the thinnest portion is $T_{min}$, the thickest portion is $T_{max}$, and the internal surface of the funnel yoke portion 22 satisfies below Equation 2.

$$1.1<T_{max}/T_{min}<2.2 \quad (2)$$

In Equation 2, the outer surface is maintained as an optimum shape in improving the deflection efficiency, by changing the internal surface shape, a BSN margin is secured.

A non-described reference numeral 100 is the internal surface of the conventional yoke portion 12, and 200 is the internal surface of the yoke portion 22 of the present invention.

TABLE 1

| | | | | | | |
|---|---|---|---|---|---|---|
| Td | 3.4 | 3.4 | 3.4 | 3.4 | 3.4 | 3.4 |
| Th | 1.4 | 2.0 | 2.7 | 3.4 | 4.1 | 4.8 |
| Th/Td | 0.4 | 0.6 | 0.8 | 1 | 1.2 | 1.4 |
| BSN(mm) | 6.0 | 5.0 | 4.1 | 3.1 | 2.2 | 1.2 |
| Tensile stress (MPa) | 13.4 | 11.8 | 11.2 | 10.7 | 10.2 | 9.5 |

Figure 9:
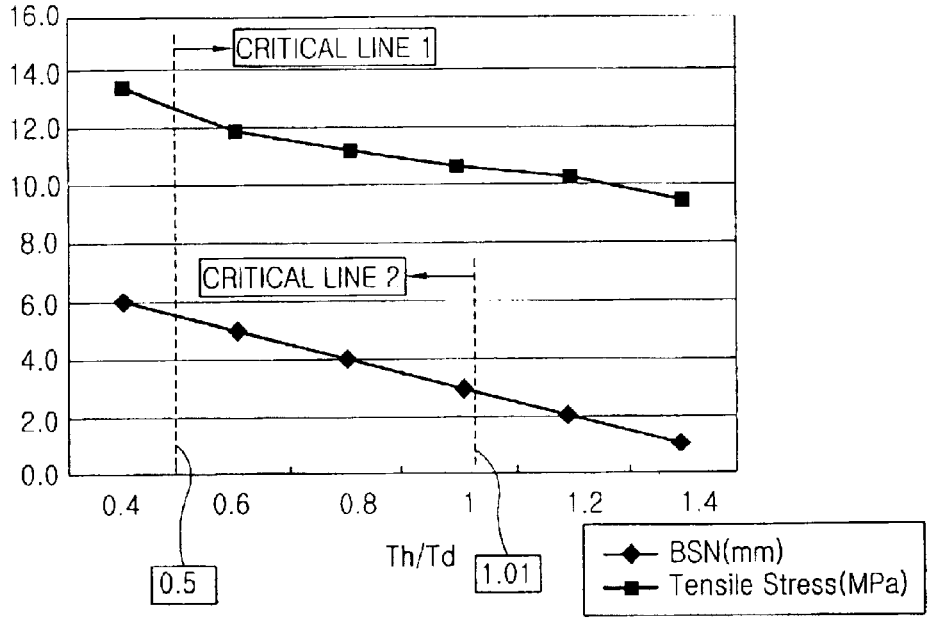
FIG. 9 is a graph illustrating a section thickness variation of a funnel yoke portion in accordance with the present invention.

Table 1 and FIG. 9 illustrate a BSN margin and a maximum tensile stress according to Th/Td of a 17 inch•120° deflection cathode ray tube having a non-circular yoke portion section.

A maximum critical stress of a general cathode ray tube is 12 MPa, in FIG. 9, a value of Th/Td has to place on the right side of a critical line 1.

In the tensile stress state not less than the maximum critical stress, according to the structural strength weakening, the cathode ray tube may be easily damaged by small impact, breakage rate in a heating process may be increased, and accordingly a yield rate may be lowered.

In addition, in a slim type cathode ray tube, explosion increase in an exhausting process may reduce the yield rate and lower a reliability related to safety.

A BSN phenomenon, in which a shadow is thrown onto a screen by an electron beam crashing onto the internal surface of the yoke portion, is the most important characteristic in quality characteristics of the cathode ray tube, at least a BSN margin has to be not less than 3.0 mm in order to secure safety. Therefore, in FIG. 9, a Th/Td ratio has to be placed on the left side of a critical line 2.

In the meantime, when a value of Th/Td is placed on the right side of the critical line 2, it means a BSN margin is not greater than 3.0, it may cause problems.

Most of all, in BSN margin shortage it is impossible to improve the deflection efficiency. In other words, a deflection efficiency is in inverse proportion to a BSN.

In more detail, the deflection efficiency increase reduces the BSN margin, and the deflection efficiency reduction increases the BSN margin.

In addition, the more a Th/Td value gets toward the right side of the critical line, the BSN margin is reduced, the BSN margin reduction increases an adjustment time of the deflection yoke, and accordingly a production time is increased.

Therefore, when a Th/Td value is placed only between the critical line 1 and the critical line 2 in FIG. 9, the BSN margin and the deflection efficiency can be increased while a stress acting on the cathode ray tube is not greater than the maximum critical stress.

Figure 10:
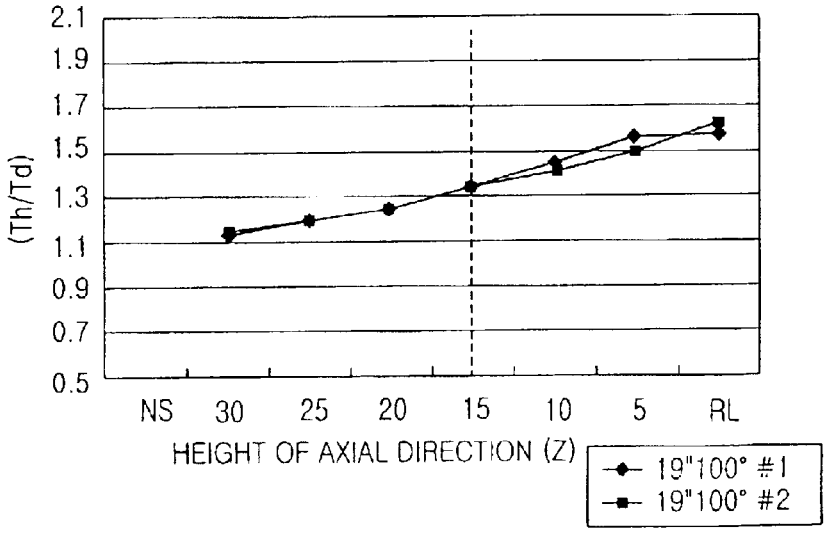
FIG. 10 is a graph illustrating a thickness ratio variation according to a height in the conventional funnel yoke portion.
Figure 11:
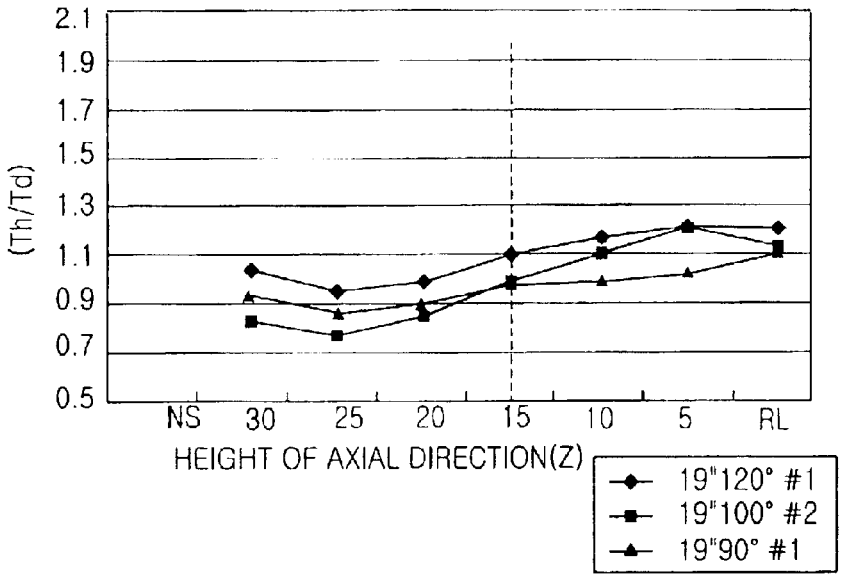
FIG. 11 is a graph illustrating a thickness ratio variation according to a height in the funnel yoke portion in accordance with the present invention.

FIG. 10 illustrates a Th/Td value in the conventional cathode ray tube having the non-circular yoke portion shape, and FIG. 11 illustrates a Th/Td value in the cathode ray tube having the non-circular yoke portion shape in accordance with the present invention.

In FIG. 10, a Th/Td ratio is not less than 1.1 between 15 mm~NSL and is in monotonic increase. In FIG. 11, a Th/Td ratio is not greater than 1.1 between 15 mm~NSL and increases after monotonic decrease.

In the meantime, in FIG. 9, when a Th/Td ratio is decreased, the BSN phenomenon occurrence is increased.

In the meantime, as described in the conventional art, when a deflection efficiency is increased to slim down the cathode ray tube and reduce a power consumption thereof, a BSN phenomenon occurrence point is moved from the RL~TOR to the RL~NSL.

Particularly, in the RL~NSL, because more BSN phenomenon occurs in the NS~15 mm, the internal surface thickness of the yoke portion is determined so as to increase the BSN margin in the NS ~15 mm.

TABLE 2

| | | | | | |
|---|---|---|---|---|---|
| $T_{max}$ | 3.4 | 3.4 | 3.4 | 3.4 | 3.4 |
| $T_{min}$ | 3.4 | 2.3 | 1.7 | 1.4 | 1.1 |
| $T_{min}/T_{max}$ | 1.0 | 1.5 | 2.0 | 2.5 | 3.0 |
| BSN (mm) | 1.9 | 3.5 | 4.3 | 4.8 | 5.1 |
| Tensile stress (MPa) | 10.7 | 10.8 | 11.2 | 13.6 | 18.4 |

Figure 12:
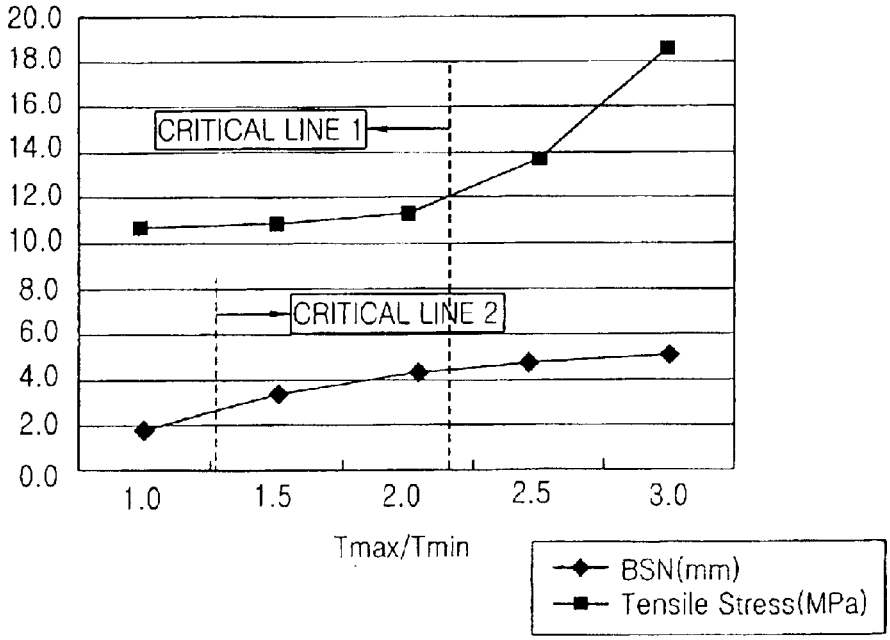
FIG. 12 is a graph illustrating a section thickness variation of the funnel yoke portion in accordance with the present invention.

Table 2 and FIG. 12 illustrate a relation between a BSN margin and a tensile stress according to a $T_{max}/T_{min}$ ratio when a maximum yoke portion thickness is $T_{max}$ and a minimum yoke portion thickness is $T_{min}$, in the RL~NSL region of the cathode ray tube.

As depicted in FIG. 12, when a $T_{max}/T_{min}$ value is placed on the left side of the critical line 1, a maximum tensile stress of the cathode ray tube is not greater than 12 MPa, when a $T_{max}/T_{min}$ value is placed on the right side of the critical line 2, a BSN margin is not less than 3.0 mm.

Accordingly, only when a $T_{max}/T_{min}$ value is placed in a region between the critical line 1 and critical line 2, the structural strength of the cathode ray tube, a BSN margin and a deflection efficiency improvement can be achieved, and accordingly it is possible to slim down the cathode ray tube and reduce a power consumption thereof.

As described above, it is essential to improve a deflection efficiency of the cathode ray tube in order to slim down the cathode ray tube and reduce power consumption thereof, however, when the deflection efficiency is increased, a BSN margin is reduced, the BSN margin reduction has a bad influence upon a quality of the cathode ray tube, increases a production time and lowers a productivity.

In more detail, because it is impossible to increase the deflection efficiency without limit in order to increase the BSN margin, it is uneasy to slim down the cathode ray tube and reduce a power consumption thereof.

However, in applying of the yoke portion structure in accordance with the present invention, because a deflection efficiency and a BSN margin can be simultaneously increased, it is possible to slim down the cathode ray tube and reduce a power consumption thereof, and accordingly a quality and a productivity of the cathode ray tube can be improved.

In addition, breakage due to impact caused by a structural strength weakening in slimming, a breakage rate in the heating process and explosion in the vacuum exhausting process can be prevented.

Hereinafter, a glass structure of a cathode ray tube in accordance with another embodiment of the present invention will be described. It is capable of securing a BSN margin related to impact resistance, breakage rate reduction in the heating process, the explosion prevention in the vacuum exhausting process and a product's reliability by not only lowering a high tensile stress formed around the TOR of the funnel 20 but also reducing the BSN phenomenon (in which the electron beam 60 around the RL crashes onto the internal surface of the yoke portion 12 and throws a shadow on the screen).

Figure 13A:
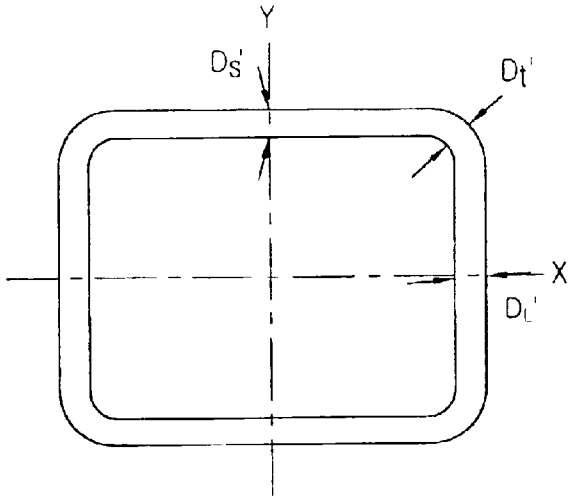
FIG. 13*a* is a sectional view illustrating a section thickness at a TOR (top of round) at the funnel yoke portion in accordance with the present invention.
Figure 13B:
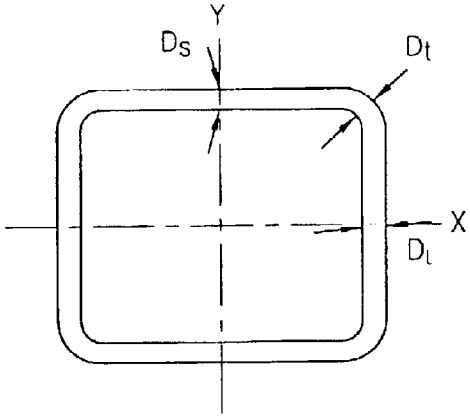
FIG. 13*b* is a sectional view illustrating a section thickness at a RL (reference line) of the funnel yoke portion in accordance with the present invention.
Figure 13C:
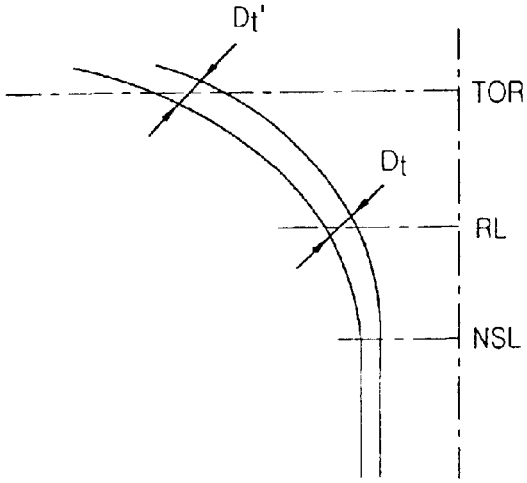
FIG. 13*c* is a schematic view illustrating a diagonal portion thickness at the funnel yoke portion in FIGS. 13*a* and 13*b*.

First, as depicted in FIG. 13*a*, a diagonal portion thickness at the TOR point is defined as Dt', as depicted in FIG. 13*b*, a diagonal portion thickness at the RL is defined as Dt.

Hereinafter, the embodiment will be described in more detail.

First, in follow Table 3, "17 Round" and "17 RAC" categories are the conventional cathode ray tube having 90° deflection, "#1", "#2" and "#3" categories are cathode ray tubes having the non-circular yoke portion and 120° deflection in accordance with the present invention.

TABLE 3

| | 17 Round | 17 RAC | #1 | #2 | #3 |
|---|---|---|---|---|---|
| Dt (RL) | 2.03 | 2.91 | 3.28 | 2.28 | 2.46 |
| Dt' (TOR) | 2.25 | 3.71 | 3.71 | 2.71 | 3.79 |
| Dt'/Dt | 1.11 | 1.27 | 1.13 | 1.19 | 1.54 |
| Maximum tensile stress | 7 MPa | 7.5 MPa | 12 MPa | 22 MPa | 12 MPa |
| BSN | 3.2 mm | 4.0 mm | 1.5 mm | 3.2 mm | 3.0 mm |

As depicted in Table 3, in categories "17 Round" and "17 RAC", a Dt'/Dt ratio is in the range of 1.1~1.3.

In general, the cathode ray tube has to have about 3 mm BSN margin, and a maximum tensile stress has to be not greater than 12 MPa.

In the meantime, category "#1" shows a maximum tensile stress and a BSN margin when a Dt'/Dt ratio is in the range of 1.1~1.3 same as the conventional 90° deflection. However, when Dt and Dt' is in the range of 3.0 mm~3.9 mm in order to secure the maximum critical tensile stress 12 MPa, it can satisfy a maximum tensile stress, however, because a BSN margin is 1.5 mm, it can not satisfy the existing BSN margin as 3.0 mm.

And, in category "#2", when a diagonal thickness Dt and Dt' of the funnel is in the range of 2.0 mm~2.9 mm, because a maximum tensile stress is 22 MPa, it largely exceeds the maximum critical stress.

In addition, in category "#3", a Dt'/Dt ratio is greater than that of the conventional cathode ray tube, a BSN margin and a maximum tensile stress can be satisfied.

Figure 14:
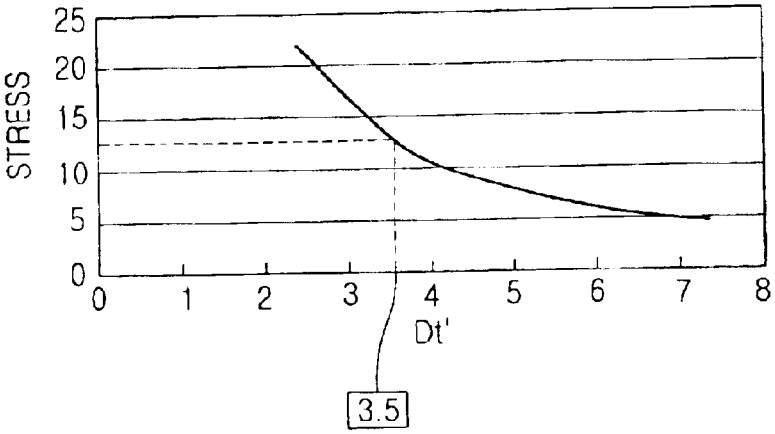
FIG. 14 is a graph illustrating a relation between a diagonal portion thickness of the funnel yoke portion and a stress in accordance with the present invention.

In a slim type brown tube, as depicted in Table 3, when a Dt is 2.46 to secure a BSN margin, the BSN margin is about 3.0 mm, after fixing the BSN margin as 3.0 mm (fixing a Dt as 2.46), Dt' is varied, FIG. 14 illustrates variation of a maximum tensile stress acting on the yoke portion.

As depicted in FIG. 14, the more Dt' increases, the maximum critical stress is gradually reduced. In consideration of the maximum critical stress as 12 MPa, Dt' has to be not less than 3.5 mm to have a value not greater than the maximum critical stress, herein, the cathode ray tube can secure a structural strength.

Figure 15:
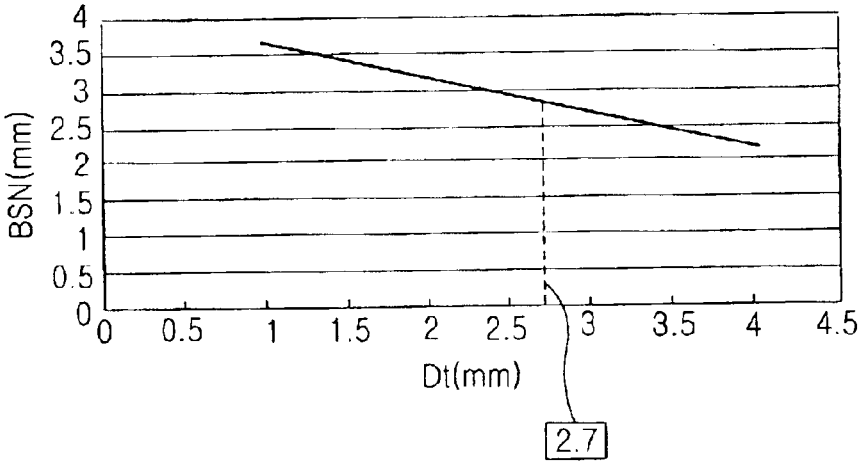
FIG. 15 is a graph illustrating a relation between a diagonal portion thickness of the funnel yoke portion and a BSN margin in accordance with the present invention.

FIG. 15 illustrates a relation between a BSN margin and Dt, the more Dt increases, a BSN margin is reduced. As described above, generally the BSN margin has to be in the range of 2.7 mm~3.0 mm, Dt' has to be not greater than 2.7 mm.

Accordingly, as depicted in FIGS. 14 and 15, in order to secure the tensile stress and the BSN margin simultaneously, Dt' has to be not less than 3.5 mm, and Dt has to be not greater than 2.7 mm.

TABLE 4

| | | | | | | | | | | |
|---|---|---|---|---|---|---|---|---|---|---|
| Dt | 3.50 | 3.18 | **2.92** | 2.69 | 2.50 | 2.33 | 2.19 | 2.06 | 1.94 | 1.84 |
| Dt' | 3.50 | 3.50 | 3.50 | 3.50 | 3.50 | 3.50 | 3.50 | 3.50 | 3.50 | 3.50 |
| Dt/Dt | 1.00 | 1.10 | 1.20 | 1.30 | 1.40 | 1.50 | 1.60 | 1.70 | 1.80 | 1.90 |
| Dt | 2.70 | 2.70 | 2.70 | 2.70 | 2.70 | 2.70 | 2.70 | 2.70 | 2.70 | 2.70 |
| Dt' | 2.70 | 2.97 | **3.24** | 3.51 | 3.78 | 4.05 | 4.32 | 4.59 | 4.86 | 5.13 |

In the upper portion of Table 4, Dt' is fixed as 3.5 mm, in the lower portion of Table 4, Dt is fixed as 2.7 mm.

First, when a Dt'/Dt ratio is smaller than 1.30, Dt' is fixed as a threshold value, Dt is 2.92 mm, in FIG. 15, a BSN margin is not greater than 2.7 mm, a shadow is thrown onto around the screen.

On the contrary, when Dt is fixed as a threshold value, Dt' is 3.24 mm, in FIG. 14, a tensile stress is not less than 12 MPa, it deteriorates the stability of the cathode ray tube.

When a Dt'/Dt ratio is not less than 1.80, there is no problem in the BSN margin and the tensile stress, a thickness difference between Dt and Dt' is not less than 2 mm, when a glass is cooled in the heating process, because a cooling speed at the surface and the internal space is ill-balanced, the glass may be damaged.

Therefore, in order to secure a stability by reducing a tensile stress of a glass, secure a BSN margin for screen quality and prevent a breakage by ill-balanced cooling, a Dt'/Dt ratio has to satisfy follow Equation 3.

$$1.3 \leqq Dt'/Dt < 1.80 \quad (3)$$

In applying of the yoke portion structure in accordance with the present invention, because a deflection efficiency and a BSN margin can be simultaneously improved, it is possible to slim down a cathode ray tube, reduce a power consumption thereof and improve a quality and a productivity of a cathode ray tube.

In addition, it is also possible to improve impact resistance of a slim type cathode ray tube, reduce a breakage rate in a heating process and prevent explosion in a vacuum exhausting process.

What is claimed is:

1. A cathode ray tube comprising a panel and a funnel including a funnel yoke portion having a non-circular-shaped vertical section, wherein a diagonal portion thickness on a certain vertical section between a reference line and a neck line is Td and a long side portion thickness at the same vertical section is Th, a glass structure of a cathode ray tube satisfies $$0.5 < Th/Td < 1.01,$$

wherein a long side direction thickness or a diagonal direction thickness of a yoke portion between a reference line and a neck seal line is varied as a monotonic increasing function shape and a monotonic decreasing function shape, and at least one relative maximum and one relative minimum exist.

2. The glass structure of claim 1, wherein a deflection angle of an electron beam is not less than 100° C.

3. The glass structure of claim 1, wherein a maximum thickness is $T_{max}$ and a minimum thickness is $T_{min}$, a $T_{max}/T_{min}$ satisfies $$1.1<T_{max}/T_{min}<2.2.$$

4. The glass structure of claim 1, wherein a Th/Td satisfies $$0.8<Th/Td<1.01.$$

5. The glass structure of claim 1, wherein the glass structure of the cathode ray tube satisfies $$Th<Tv$$

when a section portion thickness at the same vertical section is Tv.

6. The glass structure of claim 1, wherein a deflection angle of an electron beam is not less than 100°.

7. The glass structure of claim 1, wherein the cathode ray tube uses a vertical scanning method, and R (red), B (blue) and G (green) cathodes of an electron gun are parallel to a shorter axis line.

8. A cathode ray tube comprising a panel and a funnel including a funnel yoke portion having a non-circular-shaped vertical section, wherein a diagonal portion thickness on a certain vertical section between a reference line and a neck line is Td; a long side portion thickness at the same vertical section is Th; a diagonal portion thickness at a top of round is Dt'; a long side portion thickness is $D_S'$; a short side portion thickness is $D_L'$; a diagonal portion thickness at a reference line is Dt; a long side portion thickness is $D_S$, a short side portion thickness is $D_L$; a glass structure of a cathode ray tube satisfies $$1.3\leqq Dt'/Dt<1.80.$$

9. The glass structure of claim 8, wherein the glass structure of the cathode ray tube satisfies $$Dt'<D_S'.$$

10. The glass structure of claim 8, wherein the glass structure of the cathode ray tube satisfies $$Dt'<D_L'.$$

11. The glass structure of claim 8, wherein the glass structure of the cathode ray tube satisfies $$D_S'<D_L'.$$

12. The glass structure of claim 8, wherein the glass structure of the cathode ray tube satisfies $$D_S'/Dt'>1.$$

13. The glass structure of claim 8, wherein the glass structure of the cathode ray tube satisfies $$Dt'>3.5 \text{ mm}.$$

14. The glass structure of claim 8, wherein the glass structure of the cathode ray tube satisfies $$Dt<2.7 \text{ mm}.$$

15. The glass structure of claim 8, wherein the cathode ray tube has a deflection angle not less than 100°.

16. The glass structure of claim 8, wherein the cathode ray tube uses a vertical scanning method, and R (red), B (blue) and G (green) cathodes of an electron gun are parallel to a shorter axis line.

17. The glass structure of claim 8, wherein the glass structure of the cathode ray tube satisfies $$0.5<Th/Td<1.01.$$

18. The glass structure of claim 8, wherein the glass structure of the cathode ray tube satisfies $$0.8<Th/Td<1.01.$$

19. A cathode ray tube comprising:

a panel and a funnel including a funnel yoke portion having a non-circular-shaped vertical section, and a diagonal portion thickness on a certain vertical section between a reference line and a neck line is Td, a long side portion thickness at the same vertical section is Th, wherein a glass structure of a cathode ray tube satisfies $$0.5<Th/Td<0.8.$$

20. A cathode ray tube comprising a panel and a funnel including a funnel yoke portion having a non-circular-shaped vertical section, wherein a diagonal portion thickness on a certain vertical section between a reference line and a neck line is Td and a long side portion thickness at the same vertical section is Th, a glass structure of a cathode ray tube satisfies $$0.5<Th/Td<1.01,$$

wherein the glass structure of the cathode ray tube satisfies $$Th<Tv$$

when a section portion thickness at the same vertical section is Tv.

* * * * *